US006016922A

United States Patent [19]

Burman

[11] Patent Number: 6,016,922

[45] Date of Patent: Jan. 25, 2000

[54] ROTATING LUMBER SORTING DEVICE

[76] Inventor: Konstantin Burman, 2219 64 St., Brooklyn, N.Y. 11204

[21] Appl. No.: 08/953,367

[22] Filed: Oct. 17, 1997

[51] Int. Cl.[7] ..... B07C 5/06

[52] U.S. Cl. ..... 209/621; 209/517; 209/684; 209/924

[58] Field of Search ..... 209/517, 619, 209/621, 623, 624, 655, 684, 698, 924

[56] References Cited

U.S. PATENT DOCUMENTS

| | | | |
|---|---|---|---|
| 1,196,975 | 9/1916 | Pease | 209/621 |
| 2,207,131 | 7/1940 | Pellam | 209/621 |
| 2,583,447 | 1/1952 | Straub | 209/621 |
| 2,673,646 | 3/1954 | De Witt | 209/621 |
| 5,011,024 | 4/1991 | Bunney | 209/517 |

FOREIGN PATENT DOCUMENTS

| | | | |
|---|---|---|---|
| 541046 | 11/1941 | United Kingdom | 209/621 |

*Primary Examiner*—Tuan N. Nguyen
*Attorney, Agent, or Firm*—Ilya Zborovsky

[57] ABSTRACT

A rotating lumber sorting device has a rotatable transfer element provided on its periphery with a plurality of receptacles which are spaced from one another in a peripheral direction and have different widths substantially corresponding to different thickness of boards to be sorted, and a plurality of guiding elements having inlet ends located close to the transfer element and also having different widths substantially corresponding to the widths of the receptacles, so that the boards of different widths are first received into the receptacles of the transfer element with each part received in a corresponding one of the receptacles, and thereafter the boards are transferred to the guiding elements and each board is transferred from a corresponding one of the receptacles of the transfer element into a corresponding one of the guiding elements, the guiding elements having outlets which are spaced from one another so as to guide having different thickness into separate accumulating places.

11 Claims, 1 Drawing Sheet

ROTATING LUMBER SORTING DEVICE

BACKGROUND OF THE INVENTION

The present invention relates to a lumber sorting equipment.

It is well known that after separation of a round lumber into a plurality of planks or boards, it is necessary to sort them in accordance with their sizes so as to separate in one place the boards of one size, and in the other place the boards of the other size. A known equipment for the separation of the boards produced after separation or sewing includes movable means, such as a conveyor and the like which transports the separated boards. Then, usually the boards of the same sizes are manually withdrawn from the conveyor. It is understood that sorting of the lumber with such an equipment is time consuming and labor consuming.

SUMMARY OF THE INVENTION

Accordingly, it is an object of the present invention to provide a lumber sorting device which avoids the disadvantages of the prior art.

In keeping with these objects and with others which will become apparent hereinafter, one feature of the present invention resides, briefly stated, in a lumber sorting device which has a rotatable transfer element provided with a plurality of receptacles which are peripherally spaced from one another and have different widths so that ports of different thickness are received in the corresponding receptacles of different width, and a plurality of guiding elements associated with said transfer element of the said rotatable transfer element and having different width substantially corresponding to the width of said receptacles, so that during rotation of said transfer element the boards of different sizes are received in the receptacles of different sizes of said transfer element and then during further rotation discharge the boards into the corresponding guiding elements of the corresponding width.

When the device is designed in accordance with the present invention, the transfer element automatically takes the boards into its receptacles selectively so that a board of a certain thickness is received in the receptacle of the corresponding width, and then during further rotation this board is discharged into the guiding element of the same size to be transported to an accumulating vessel for accumulation of the boards of the corresponding thickness.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

The single FIGURE of the drawings is a view schematically showing a rotating lumber sorting device in accordance with the present invention.

DESCRIPTION OF PREFERRED EMBODIMENTS

Figure 1:
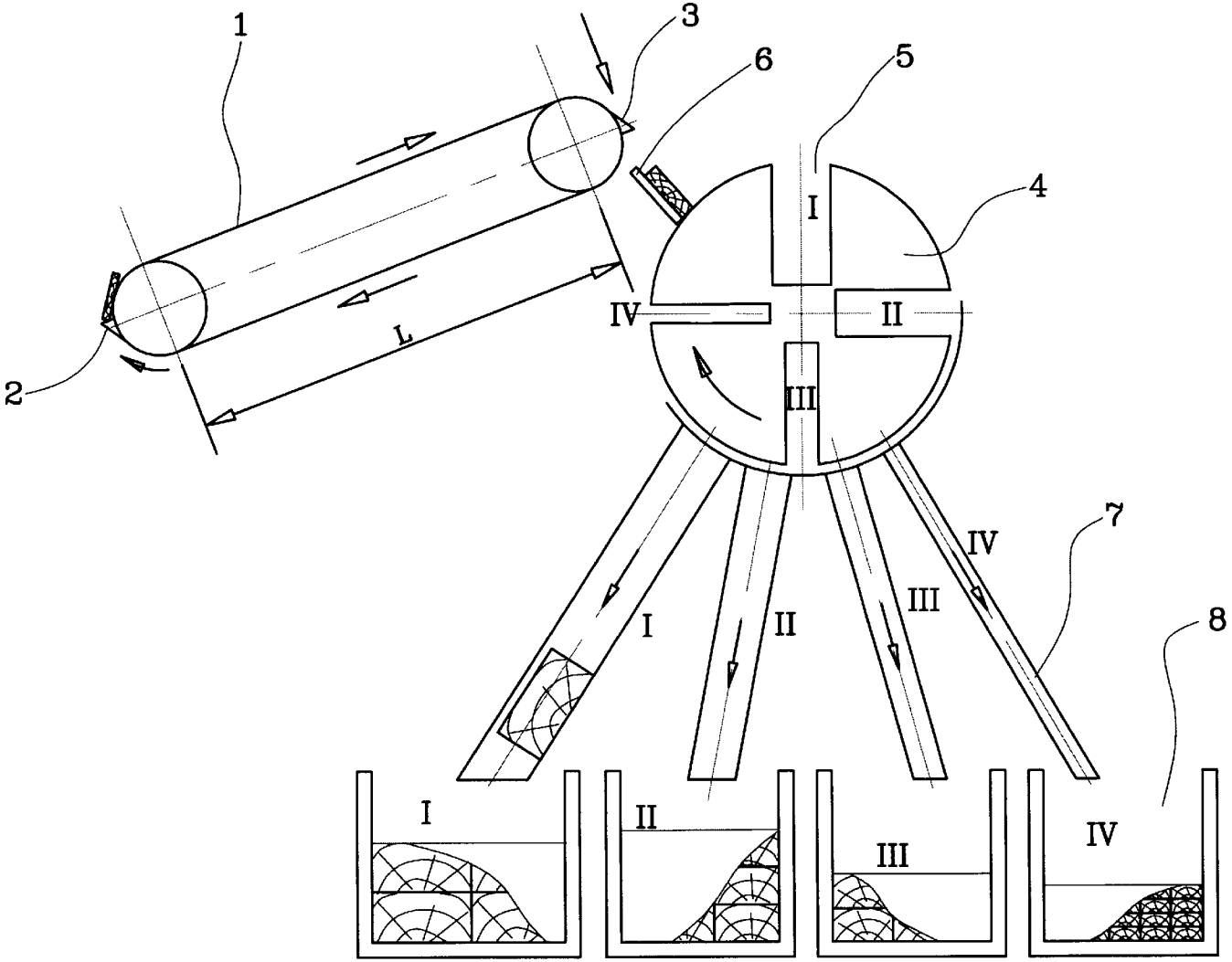

A rotary lumber sorting device in accordance with the present invention has an endless conveyor which is identified as a whole with reference numeral 1 and can be formed as a band conveyor. The band of the conveyor is provided with two projections 2 and 3 which are spaced from one another and preferably have a straight flank and an inclined flank. As can be seen from the drawing, the straight flank of the projection 2 is used for supporting a board to be transported by the conveyor 1 from below upwardly. The inclined frank of the projection 3 is used for guiding the board from the conveyor 1.

The device further has a transfer element 4 which is formed as a rotatable drum. The drum rotates about its axis, being driven by a not shown drive, for example a motor and the like. The drum 4 is provided with a plurality of receptacles I, II, III, IV, V which are spaced from one another circumferentially. The receptacles are formed as slots extending in an axial direction and having different circumferential widths. If the drum 4 rotates in a clockwise direction, then the width of the slots increases in a counterclockwise direction, for the purpose which will be explained hereinbelow. A guiding plate 6 can be provided for guiding a board from the projection 3 of the conveyor 1 to periphery of the drum 4. The device further has a plurality of guiding elements 7 which can be formed for example as hollow tubes or the like. The guiding elements 7 have inlet ends associated with the drum 4 and spaced from one another in a circumferential direction of the drum. The guiding element 7 have different width substantially corresponding to the widths of the slots 5 in the drum 4. The width of the guiding element 7 increases in a clockwise direction. The other ends of the guiding element 7 are located near openings of accumulating vessels 8 for accumulation of boards having different thickness.

The rotating lumber sorting device in accordance with the present invention operates in the following manner:

The boards are supplied onto the conveyor 1 and transported from below upwardly one after the other. Then the boards are moved towards the periphery of the drum 4 under the action of gravity. During rotation of the drum in the clockwise direction, the boards fall in the corresponding slots 5. Each board is received in a slot 5 having the width which corresponds to the thickness of the board. In order to achieve an orderly transfer of the board from the conveyor 1 into the slots 5 of the drum 4, the length of the conveyor corresponds to the circumference of the drum. In other words $L=2\pi R$. During rotation of the drum 4 the boards from the slots fall under the action of gravity into the guiding tubes 7. Each board falls into the guiding tube with a width corresponding to the thickness of the board. The boards then slide down through the guiding tubes 7 into corresponding accumulating vessels.

As a result, each accumulating vessel 8 accumulates the boards of the same thickness.

The drawing shows an elevational view of the device. In other words, the drum 4 is located above the guiding elements 7, the guiding elements 7 are located above the accumulating vessels 8, while the conveyor 1 is inclined in a vertical plane. Therefore, the transfer of the boards from the conveyor element 1 into the drum 4, into the guiding element 7 and then into the accumulating vessels 8 is performed under the action gravity. The drum 4 is rotatable about a horizontal axis. Such a device does not require energy sources with high power, and also it is very compact.

It will be understood that each of the elements described above, or two or more together, may also find a useful application in other types of constructions differing from the types described above.

While the invention has been illustrated and described as embodied in rotating lumber supporting device, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed and desired to be protected by Letters Patent is set forth in the appended claims:

1. A rotating lumber sorting device, comprising a rotatable drum-shaped transfer element provided on its periphery with a plurality of receptacles which are spaced from one another in a peripheral direction and have different widths substantially corresponding to different thickness of boards to be sorted; a plurality of guiding elements having inlet ends located close to said transfer element and also having different widths substantially corresponding to the widths of said receptacles, so that the boards of different widths are first received into said receptacles of said transfer element with each board received in a corresponding one of said receptacles, and thereafter the boards are transferred to said guiding elements and each board is transferred from a corresponding one of said receptacles of said transfer element into a corresponding one of said guiding elements, said guiding elements having outlets which are spaced from one another so as to guide boards having different thickness into separate accumulating places; and a conveyor for transporting boards to said transfer element, said conveyor having two projections which are spaced from one another and each having a straight flank for supporting a board to be transported and an inclined flank for sliding a board from the conveyor onto said transfer element.

2. A rotating lumber sorting device, comprising a rotatable drum-shaped transfer element provided on its periphery with a plurality of receptacles which are spaced from one another in a peripheral direction and have different and constant widths substantially corresponding to different thickness of boards to be sorted; a plurality of guiding elements having inlet ends located close to said transfer element and also having different widths substantially corresponding to the widths of said receptacles, so that the boards of different widths are first received into said receptacles of said transfer element with each board received in a corresponding one of said receptacles, and thereafter the boards are transferred to said guiding elements and each board is transferred from a corresponding one of said receptacles of said transfer element into a corresponding one of said guiding elements, said guiding elements having outlets which are spaced from one another so as to guide boards having different thickness into separate accumulating places; and a conveyor for transporting boards to said transfer element, said transfer element being rotatable in a predetermined direction, said widths of said receptacles increasing in a direction which is opposite to said predetermined direction, said conveyor having a length corresponding to a circumference of said rotatable transfer element.

3. A rotating lumber sorting device as defined in claim 2, wherein said transfer element has a horizontal axis of rotation.

4. A rotating lumber sorting device as defined in claim 2, wherein said transfer element is located above said guiding elements so that the boards fall from said transfer elements into said guiding elements under the action of gravity.

5. A rotating lumber sorting device as defined in claim 2, said conveyor is inclined in a vertical plane and has an upper area located in the region of said transfer element.

6. A rotating lumber sorting device as defined in claim 2, wherein said receptacles are formed as elongated slots extending in an axial direction of said transfer element.

7. A rotating lumber sorting device as defined in claim 2, wherein said guiding elements are formed as hollow tubes.

8. A rotating lumber sorting device as defined in claim 2; and further comprising a plurality of accumulating vessels each located in the region of said outlet of a respective one of said guiding elements so that each of said vessels receives the boards of a substantially same thickness.

9. A rotating lumber sorting device as defined in claim 8, wherein said vessels are located under said guiding elements.

10. A rotating lumber sorting device as defined in claim 2, wherein said guiding elements are located under said transfer element.

11. A rotating lumber sorting device as defined in claim 2, wherein $L=2\pi R$ wherein L is a length of said conveyor and R is a radius of said drum-shaped transfer element.

* * * * *